US007276655B2

(12) United States Patent
Lin et al.

(10) Patent No.: US 7,276,655 B2
(45) Date of Patent: Oct. 2, 2007

(54) MUSIC SYNTHESIS SYSTEM

(75) Inventors: Tzueng-yau Lin, Shalu Jen (TW); Pei-chen Chang, Tainan (TW)

(73) Assignee: Mediatek Incorporated, Hsin-Chu (TW)

( * ) Notice: Subject to any disclaimer, the term of this patent is extended or adjusted under 35 U.S.C. 154(b) by 324 days.

(21) Appl. No.: 11/054,660

(22) Filed: Feb. 9, 2005

(65) Prior Publication Data

US 2005/0188819 A1 Sep. 1, 2005

(30) Foreign Application Priority Data

Feb. 13, 2004 (TW) ..... 93103579 A

(51) Int. Cl.
*G10H 7/00* (2006.01)

(52) U.S. Cl. ..... 84/603; 84/604; 84/645

(58) Field of Classification Search ..... 84/603, 84/604, 645; 711/206
See application file for complete search history.

(56) References Cited

U.S. PATENT DOCUMENTS 4,622,877 A * 11/1986 Strong ..... 84/604
4,715,257 A * 12/1987 Hoshiai et al. ..... 84/603
4,922,794 A * 5/1990 Shibukawa ..... 84/601
5,300,724 A * 4/1994 Medovich ..... 84/604
5,444,818 A * 8/1995 Lisle ..... 704/258
5,486,644 A * 1/1996 Kudo et al. ..... 84/604
5,553,011 A * 9/1996 Fujita ..... 708/272
5,591,930 A * 1/1997 Kakishita et al. ..... 84/602
5,596,159 A * 1/1997 O'Connell ..... 84/622
5,675,762 A * 10/1997 Bodin et al. ..... 711/206
5,689,080 A * 11/1997 Gulick ..... 84/604
5,698,802 A * 12/1997 Kamiya ..... 84/604
5,717,154 A * 2/1998 Gulick ..... 84/604
5,744,739 A * 4/1998 Jenkins ..... 84/603
5,744,742 A * 4/1998 Lindemann et al. ..... 84/623
5,753,841 A * 5/1998 Hewitt ..... 84/604
5,763,801 A * 6/1998 Gulick ..... 84/604
5,817,964 A * 10/1998 Kosugi ..... 84/607
5,824,935 A * 10/1998 Tanaka ..... 84/631
5,847,304 A * 12/1998 Hewitt ..... 84/622
5,862,063 A * 1/1999 Thome et al. ..... 708/290
5,872,727 A * 2/1999 Kuo ..... 708/313
5,890,115 A * 3/1999 Cole ..... 704/258
5,896,291 A * 4/1999 Hewitt et al. ..... 700/94
5,901,333 A * 5/1999 Hewitt ..... 710/52
5,917,917 A * 6/1999 Jenkins et al. ..... 381/63

(Continued)

*Primary Examiner*—Lincoln Donovan
*Assistant Examiner*—Christina Russell
(74) *Attorney, Agent, or Firm*—Hoffman, Warnick & D'Alessandro LLC

(57) ABSTRACT

The invention relates to a music synthesis system for synthesizing a corresponding digital music output according to commands from a music data file. The music data file comprises a plurality of music data units. Each music data unit records related information of the music. The music synthesis system comprises a wavetable, a memory, a music analyzer, a wavetable preprocessor, and a synthesizer. The wavetable pre-stores the digital sampling data. The memory has a predetermined memory capacity for storing data. The music analyzer receives the music data file, analyzes the music data units of the music data file, and generates a corresponding analysis result. The wavetable preprocessor selects the digital sampling data with relatively greater importance in the wavetable and stores the selected digital sampling data in the memory. The synthesizer selects the digital sampling data from the memory and synthesizes the digital music output.

16 Claims, 4 Drawing Sheets

U.S. PATENT DOCUMENTS 5,973,251 A * 10/1999 Mukojima et al. ..... 84/603
5,987,584 A * 11/1999 Chambers et al. ..... 711/220
6,008,446 A * 12/1999 Van Buskirk et al. ..... 84/603
6,011,213 A * 1/2000 Duruoz ..... 84/703
6,018,118 A * 1/2000 Smith et al. ..... 84/600
6,040,515 A * 3/2000 Mukojima et al. ..... 84/603
6,047,365 A * 4/2000 Chambers et al. ..... 711/220
6,096,960 A * 8/2000 Scott ..... 84/603
6,100,461 A * 8/2000 Hewitt ..... 84/603
6,101,469 A * 8/2000 Curtin ..... 704/258
6,124,542 A * 9/2000 Wang ..... 84/603
6,137,046 A * 10/2000 Kamiya ..... 84/604
6,138,224 A * 10/2000 Lisle ..... 711/206
6,180,864 B1 * 1/2001 Furuhashi et al. ..... 84/603
6,195,736 B1 * 2/2001 Lisle ..... 711/206
6,253,172 B1 * 6/2001 Ding et al. ..... 704/219
6,362,409 B1 * 3/2002 Gadre ..... 84/603
6,426,456 B1 * 7/2002 Khawand et al. ..... 84/624
6,529,191 B1 * 3/2003 Ryo ..... 345/419
6,630,621 B1 * 10/2003 Yamada et al. ..... 84/603
6,643,744 B1 * 11/2003 Cheng ..... 711/137
6,900,381 B2 * 5/2005 Lindgren et al. ..... 84/603
6,976,108 B2 * 12/2005 Kim et al. ..... 710/240
7,088,835 B1 * 8/2006 Norris et al. ..... 381/107
2002/0124715 A1 * 9/2002 Fay ..... 84/645
2003/0033338 A1 * 2/2003 Lindgren et al. ..... 708/315
2004/0158470 A1 * 8/2004 Kawahara et al. ..... 704/266
2004/0226434 A1 * 11/2004 Hsieh et al. ..... 84/627
2004/0231497 A1 * 11/2004 Hsieh ..... 84/622
2005/0011341 A1 * 1/2005 Petef ..... 84/622
2005/0080498 A1 * 4/2005 Tico et al. ..... 700/94
2005/0114136 A1 * 5/2005 Hamalainen et al. ..... 704/258

* cited by examiner

MUSIC SYNTHESIS SYSTEM

BACKGROUND OF THE INVENTION

1. Field of the Invention

The present invention relates to a music synthesis system. In particular, the present invention relates to a wavetable synthesis system for synthesizing a corresponding digital music output according to commands from a music data file.

2. Description of the Prior Art

Referring to FIG. 1, FIG. 1 is a schematic diagram of a conventional music synthesis system 10. The music synthesis system comprises a sequencer 12, a wavetable 14, a memory 15, and a synthesizer 16. The music synthesis system 10 is used for synthesizing a corresponding digital music output 20 according to commands specified in a music data file 18. The music data file 18 comprises a plurality of music data units (19*a*, 19*b*, . . . ). Each music data unit records related information of each music segment of the music.

As shown in FIG. 1, the wavetable 14 is used for pre-storing a plurality of digital sampling data (22*a*, 22*b*, . . . ). The memory 15 is used for storing the wavetable 14. The wavetable 14 can originally be stored in the memory 15, or originally be stored in a memory external to the music synthesis system 10 (such as in other memory, optical storage medium, or even network . . . etc.) and then be read into the memory 15. The sequencer 12 is used for receiving the music data file 18 and generating a result 24. The synthesizer 16 is used for selecting the required digital sampling data from the wavetable 14 according to the sequencer's result 24, so as to synthesize the digital music output 20. Each digital sampling data represents the sampling data of a piece of music generated by a specific musical instrument at a predetermined pitch. For example, the digital sampling data 22*a* represents the sampling data of the music generated by a piano at pitch C, and the digital sampling data 22*b* represents the sampling data of the music generated by a violin at pitch G.

Referring to FIG. 2, FIG. 2 is a waveform diagram of the digital sampling data 22*a* shown in FIG. 1. Each digital sampling data in FIG. 1 represents the sampling data of the music generated by a specific musical instrument at a predetermined pitch, and the sampling data is sampled for a predetermined duration (T) and then stored in the wavetable 14. As shown in FIG. 2, a duration (T) of the sampling data is extracted from the digital sampling data 22*a* and then stored in the wavetable 14. A looping point 32 is marked to serve as an important basis when requests are made as to the synthesis of different durations of the digital sampling data 22*a*. In general, the digital sampling data (22*a*, 22*b*, . . . ) are stored without performing data compression because the compression of the digital sampling data might cause the looping point 32 to disappear. As shown in FIG. 2, the compression of the digital sampling data 22*a* is done by selecting a predetermined amount of compression points 34 from the digital sampling data 22*a* and only storing these compression points 34, so as to reduce the data size. The decompression procedure could be, for example, performing interpolation calculation using the compression points 34 so as to restore the original digital sampling data 22*a*. However, the mark of the looping point 32 may possibly disappear during the compression and decompression procedures. Therefore, in many documents, even the manual of the MIDI 1.0 does not recommend to compress the digital sampling data (22*a*, 22*b*, . . . ).

In conventional music synthesis system 10, the memory 15 for storing the wavetable 14 is usually the flash memory or ROM. The cost for storing the uncompressed wavetable 14 in the memory 15 is usually one of the most significant part in the total cost. For reducing the cost of storing the wavetable 14, it is usually for the prior to store only the sampling data at one or two predetermined pitches of a specific musical instrument. For example, for the sampling data of the music of a piano, the wavetable 14 only stores the digital sampling data 22*a* representing the piano at pitch C. Therefore, when the music synthesis system 10 shown in FIG. 1 synthesizes the digital music output 20, the synthesizer 16 is required to perform pitch-shifting to the selected digital sampling data, so as to generate the digital sampling data at other pitches which are not stored for the specific musical instrument.

Referring to FIG. 3, FIG. 3 is a schematic diagram when the synthesizer 16 shown in FIG. 1 performs pitch-shifting. For example, if the digital music output 20 requires piano music at pitch C, D, F, and G, but the wavetable 14 only stores the digital sampling data 22*a* of the piano at pitch C, the synthesizer 16 will perform pitch-shifting on the digital sampling data 22*a*, so as to calculate the digital sampling data (22*p*, 22*q*, and 22*r*). Moreover, the music synthesis system 10 performs pitch-shifting in real-time during the process of synthesizing the digital music output 20. For example, if the music data unit 19*a* and another music data unit 19*b* both comprise the music of piano at pitch F, the synthesizer 16 will need to perform pitch-shifting once when synthesizing the music data unit 19*a* according to the commands specified in the music data file 18, and when synthesizing the music data unit 19*b*, the synthesizer 16 still needs to perform pitch-shifting once more. Therefore, a large number of repeated calculations of pitch-shifting could be a heavy processing load to conventional music synthesis system 10.

According to the above, conventional music synthesis system 10 has the disadvantages of high storing cost and high calculating cost.

SUMMARY OF THE INVENTION

The objective of the present invention is to provide a music synthesis system and method for performing memory management according to the importance of the data, so as to decrease the cost and processing load and maintain the quality of the digital music output.

The present invention provides a music synthesis system for synthesizing a corresponding digital music output according to commands specified in a music data file. According to one embodiment, the music data file comprises a plurality of music data units. Each music data unit records related information of the music. This kind of information usually, but not limited to, comprises the current pitch, duration, and type of the musical instrument of the music.

In the embodiment, the music synthesis system comprises a wavetable, a first memory, a second memory, a music analyzer, a wavetable preprocessor, and a synthesizer. The wavetable is used for storing a plurality of digital sampling data. Each digital sampling data represents audio signals generated by a specific musical instrument at a predetermined pitch. The memory has a predetermined memory capacity for storing data. The music analyzer is used for receiving the music data file, and according to a predetermined music analysis procedure, it is also used for analyzing the music data units of the music data file and generating a corresponding analysis result constituting an importance analysis table. The wavetable preprocessor is used for selecting the digital sampling data with relatively higher importance in the wavetable from the first memory according to system capacity, inter alia, the memory capacity of the second memory and the analysis result, and then it stores the selected digital sampling data in the second memory. The synthesizer is used for selecting the required digital sampling data from the second memory according to the music data file and for synthesizing the digital music output requested according to commands specified in the music data file. The above-mentioned first and second memory can be put into practice by two memories or one memory with a large memory capacity.

According to the embodiment, a music synthesis system and method for performing memory management according to the importance of a data is provided. The analysis result in the importance analysis table can be used to facilitate the limited-capacity of the memory in a more efficient way. Instead of storing all the received uncompressed music data files as performed in the prior arts, the inclusion of this table in the present music synthesis system generally allows only the storage of the digital sampling data with higher importance in the limited memory. If the memory capacity of the memory allows, the wavetable preprocessor can perform pitch-shifting to part of the digital sampling data and store those data in the memory, so as to share the processing load of the synthesizer and avoid performing the required calculations of pitch-shifting repeatedly. Therefore, the music synthesis system could decrease the cost and processing load while maintaining the quality of the digital music output.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
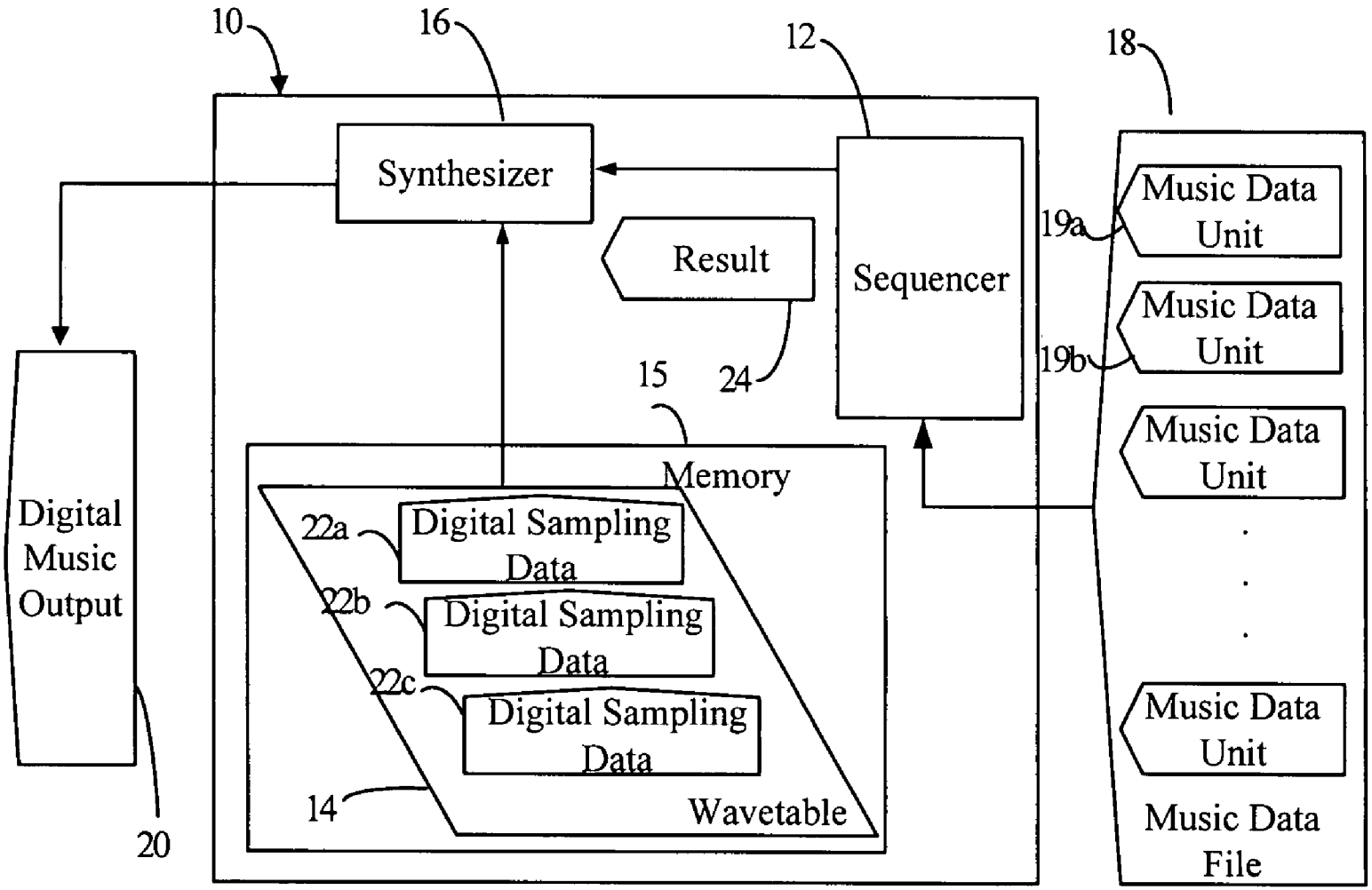
FIG. 1 (Prior Art)
FIG. 1 is a schematic diagram of a conventional music synthesis system.
Figure 2:
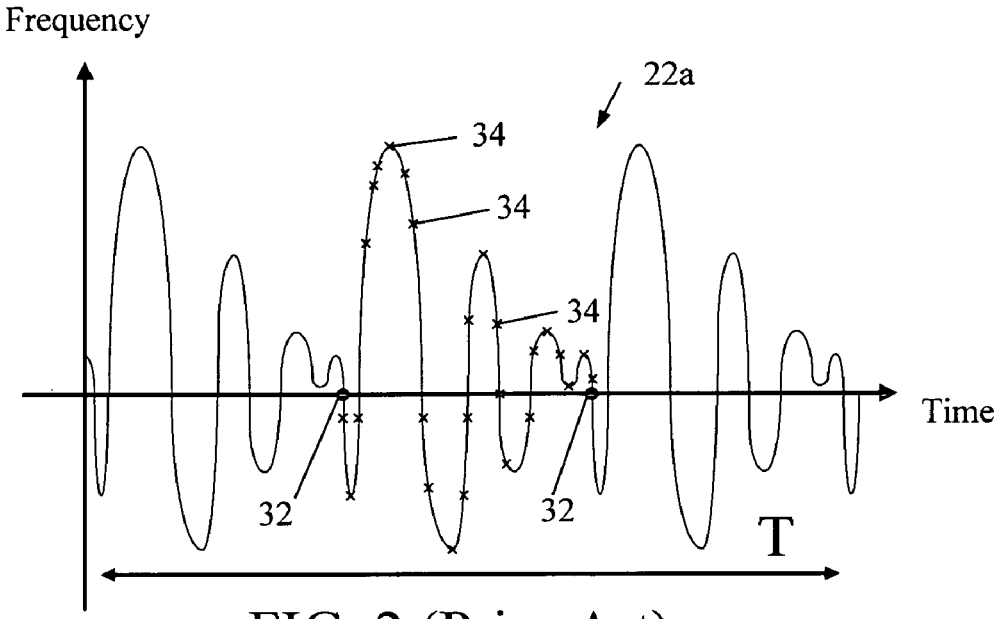
FIG. 2 (Prior Art)
FIG. 2 is a waveform diagram of the digital sampling data shown in FIG. 1.
Figure 3:
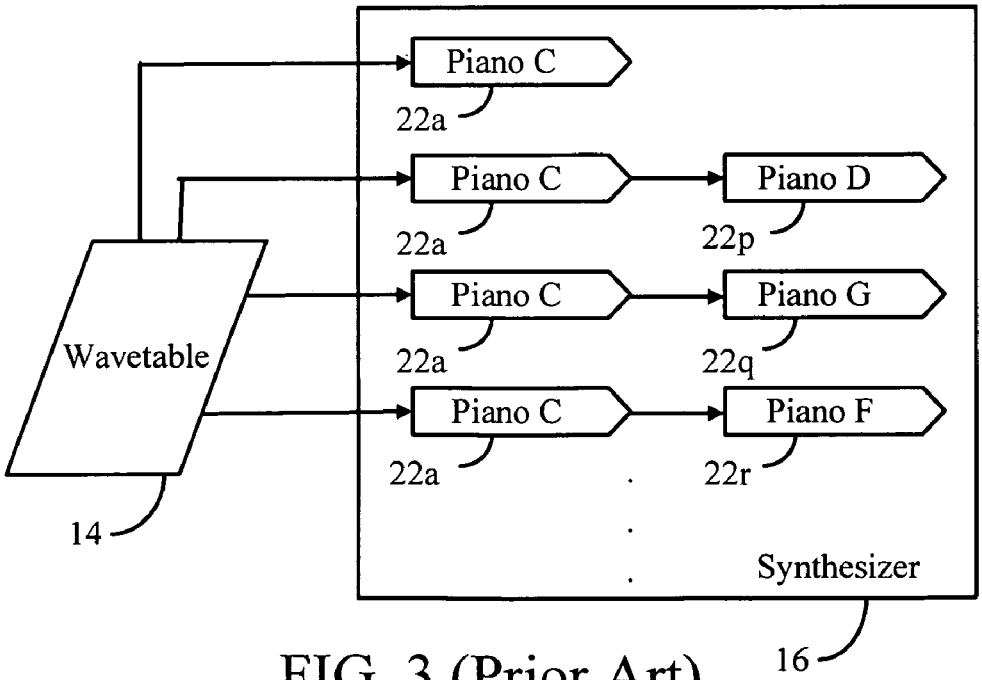
FIG. 3 (Prior Art)
FIG. 3 is a schematic diagram when the synthesizer shown in FIG. 1 performs pitch-shifting.
Figure 4:
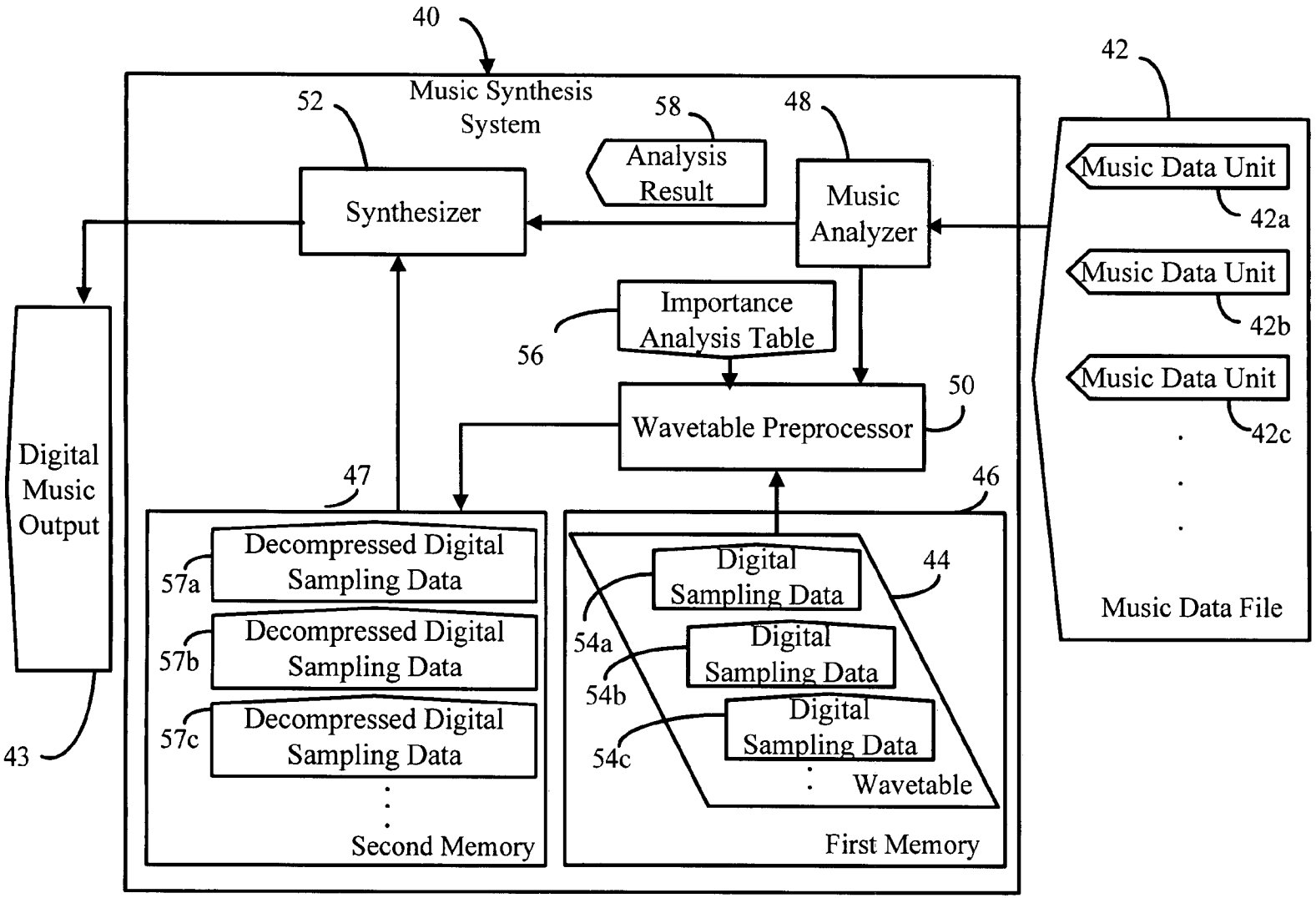
FIG. 4 is a schematic diagram of the music synthesis system of an embodiment.

Referring to FIG. 4, FIG. 4 is a schematic diagram of the music synthesis system 40 of the embodiment. The music synthesis system 40 is used for reading a music data file 42 and synthesizing a corresponding digital music output 43 according to commands specified in the music data file 42. The music synthesis system 40 comprises a wavetable 44, a first memory 46, a second memory 47, a music analyzer 48, a wavetable preprocessor 50, and a synthesizer 52. The digital music output 43 can be transmitted to a digital/analog converter (not shown) and a speaker (not shown) for converting the digital music output 43 into audible music or audio sounds.

The music data file 42 could be obtained by decoding a MIDI data stream. The music data file 42 comprises a plurality of music data units (42*a*, 42*b*, 42*c*, . . . ). A music data unit(42*a*, 42*b* or 42*c*) usually, but not limited to, represents the audio signals of a specific musical instrument performed at a specific pitch. Each music data unit records the related information of each segment of music. In this embodiment, the related information includes the pitch, the duration, and the type of the musical instrument of the music.

The wavetable 44 is used for pre-storing a plurality of digital sampling data (54*a*, 54*b*, 54*c*, . . . ); each digital sampling data represents the audio signals generated by a specific musical instrument performed at a predetermined pitch. For example, the digital sampling data 54*a* represents the audio signals of the music generated by a piano at pitch C, and the digital sampling data 54*b* represents the audio signals of the music generated by a violin at pitch G. In the present embodiment, the wavetable 44 is stored in the first memory 46. In the music synthesis system 40, the first memory 46 comprises a predetermined memory capacity for storing data. To be more specific, the wavetable 44 could be originally stored in the first memory 46, or it could be stored in other storage device external to the music synthesis system 40, and then be read into the first memory 46. The external storage device could be, for example, other memory devices, optical storage medium, or resources from the network.

The music analyzer 48 is used for receiving the music data file 42 and for generating an analysis result 58. Besides, the music analyzer 48 can analyze the music data units (42*a*, 42*b*, 42*c*, . . . ) according to a predetermined music analysis procedure and can generate a corresponding importance analysis table 56. The wavetable preprocessor 50 is used for selecting the digital sampling data (57*a*, 57*b*, and 57*c*) with relatively higher importance in the wavetable 44 according to the memory capacity of the second memory 47 and the importance analysis table 56, and those data are temporarily stored in the second memory 47; the meaning of relatively higher importance will be described later. The synthesizer 52 is used for selecting the required decompressed digital sampling data from the second memory 47 according to the music data file 42 and for synthesizing the digital music output 43 according to commands specified in the music data file 42. The synthesizer 52 obtains the information, which is required during the synthesis of the digital music output 43, by the analysis result 58.

By employing the wavetable preprocessor 50, the digital sampling data (54*a*, 54*b*, 54*c*, . . . ) can be reduced in size through a predetermined data compression procedure before they are stored in the wavetable 44. After the wavetable preprocessor 50 selects the digital sampling data (54*a*, 54*b*, 54*c*, . . . ) from the wavetable, the wavetable preprocessor 50 performs a decompression procedure and then temporarily stores the decompressed digital sampling data in the second memory 47. The corresponding compression procedure can be designed to cooperate with the decompression procedure. With proper design, the compression/decompression procedures can work in tandem to prevent the problem arising from the disappearance of the looping points if an improper decompress procedure of digital sampling data (54*a*, 54*b*, 54*c*, . . . ) is used. In the music synthesis system 40 according to the present invention, the digital sampling data (54*a*, 54*b*, 54*c*, . . . ) are stored in the wavetable 44 in a compressed format. In contrast, it is uncompressed digital sampling data that are stored in the wavetable of the conventional music synthesis system 10. Therefore, the present invention fashions an economical means to use less memory capacity to store the wavetable 44.

In the following, it is intended to provide a more detailed description for those digital sampling data (57*a*, 57*b*, 57*c*, . . . ) temporarily stored in the second memory 47 and possessing "relatively higher importance" according to the present invention. The digital sampling data stored in the wavetable 44 generally includes a plurality of orchestral music sampling data and a plurality of percussion music sampling data. For example, the wavetable usually includes 128 orchestral music sampling data and 47 percussion music sampling data. However, in most cases, the music data file 42 only requires a part, but not all, of the digital sampling data stored in the wavetable 44. For example, the music data file 42 requires 8 orchestral music sampling data and 3 percussion music sampling data. Therefore, the predetermined music analysis procedure performs classification, statistics, and sorting to all the music data units (42*a*, 42*b*, 42*c*, . . . ) according to the type of the musical instrument or the pitch recorded in the music data units (42*a*, 42*b*, 42*c*, . . . ), so as to obtain the importance analysis table 56. The importance of each digital sampling data depends on the contribution of the digital sampling data from which the digital music output is later synthesized. The importance analysis table 56 is arranged and sequentially sorted according to the contributions of the digital sampling data. By the music analysis procedure, the music synthesis system 40 could find out the digital sampling data required by the music data file 42, and the relative importance among the digital sampling data can therefore be parsed. In a practical case, the capacity of the second memory 47 is usually limited. Selection, as to which digital sampling data are to be decompressed and then stored in the second memory 47, has to be made according to the capacity of the second memory 47. Facilitated by the importance analysis table 56, the wavetable preprocessor 50 could then select and performs decompression on the digital sampling data having relatively higher importance from the wavetable in the first memory 46, and could then store the decompressed digital sampling data in the second memory 47.

For a specific musical instrument, usually digital sampling data of only one or two predetermined pitches are stored in the wavetable 44 due to the limited memory capacity. When in need, one or more digital sampling data of one particular musical instrument can be synthesized by pitch-shifting. In this fashion, the digital sampling data of another pitch of the same musical instrument is thus generated. The synthesizer 52 selects the required digital sampling data from the second memory 47 according to the analysis result 58 of the music data file 42 and performs the necessary pitch-shifting, so as to fully synthesize the digital music output 43. If the memory capacity of the second memory 47 permits, the wavetable preprocessor 50 could also perform pitch-shifting on some of the digital sampling data and the new data are then stored in the second memory 47. This can share the processing load of the synthesizer 52. In other words, the synthesizer 52 does not need to perform pitch-shifting in real time. For example, assume that only the digital sampling data of the piano at pitch C is stored in the wavetable 44. If it is intended to synthesize the digital music output 43 of the piano at pitches C, D, F, and G, the embodiment of the present invention can simulate and generate the digital sampling data of the piano at pitches D, F, and G by the digital sampling data of the piano at pitch C, and stores the data in the second memory 47. Therefore, when the synthesizer 52 needs to use the digital sampling data of the piano at pitches D, F, and G, the synthesizer 52 can directly read from the second memory 47 instead of performing pitch-shifting in real time. According to the embodiment, because the digital sampling data are stored in the wavetable 44 in a compressed format, the required memory capacity could be reduced. When necessary, pitch-shifting can be performed on some of the digital sampling data in advance. The outcome therefrom can be stored in the second memory 47 and be used by the synthesizer 52 later. In this way, this embodiment solves the problems of conventional synthesizers which either require a large number of calculations for pitch-shifting or require a large memory capacity for storing uncompressed digital sampling data.

As to the importance analysis table 56, the importance of each digital sampling data is determined according to the contribution of the digital sampling data from which the digital music output is later synthesized. The content of the importance analysis table 56 can be arranged and sequentially sorted/prioritized according to the contributions of the corresponding digital sampling data. In the present embodiment, the contribution is determined according to the related information recorded in the music data units (42*a*, 42*b*, 42*c*, . . . ). The contribution of the digital sampling data can be evaluated/determined in proportion to the frequency of the digital sampling data during synthesis. The contribution can also be evaluated/determined based on the frequency the digital sampling data would be used for the simulation of other pitches.

In another embodiment, the contribution can also be evaluated/determined based on the duration. During the analysis of the related information recorded in the music data units (42*a*, 42*b*, 42*c*, . . . ) and the synthesis of the digital music output, if the duration of one digital sampling data is longer, the contribution and the importance of that digital sampling data will be larger. Another alternative can be made to the determination of the contribution. If the duration of one digital sampling data from which other pitches are simulated is longer, the contribution of the digital sampling data will be larger.

Figure 5:
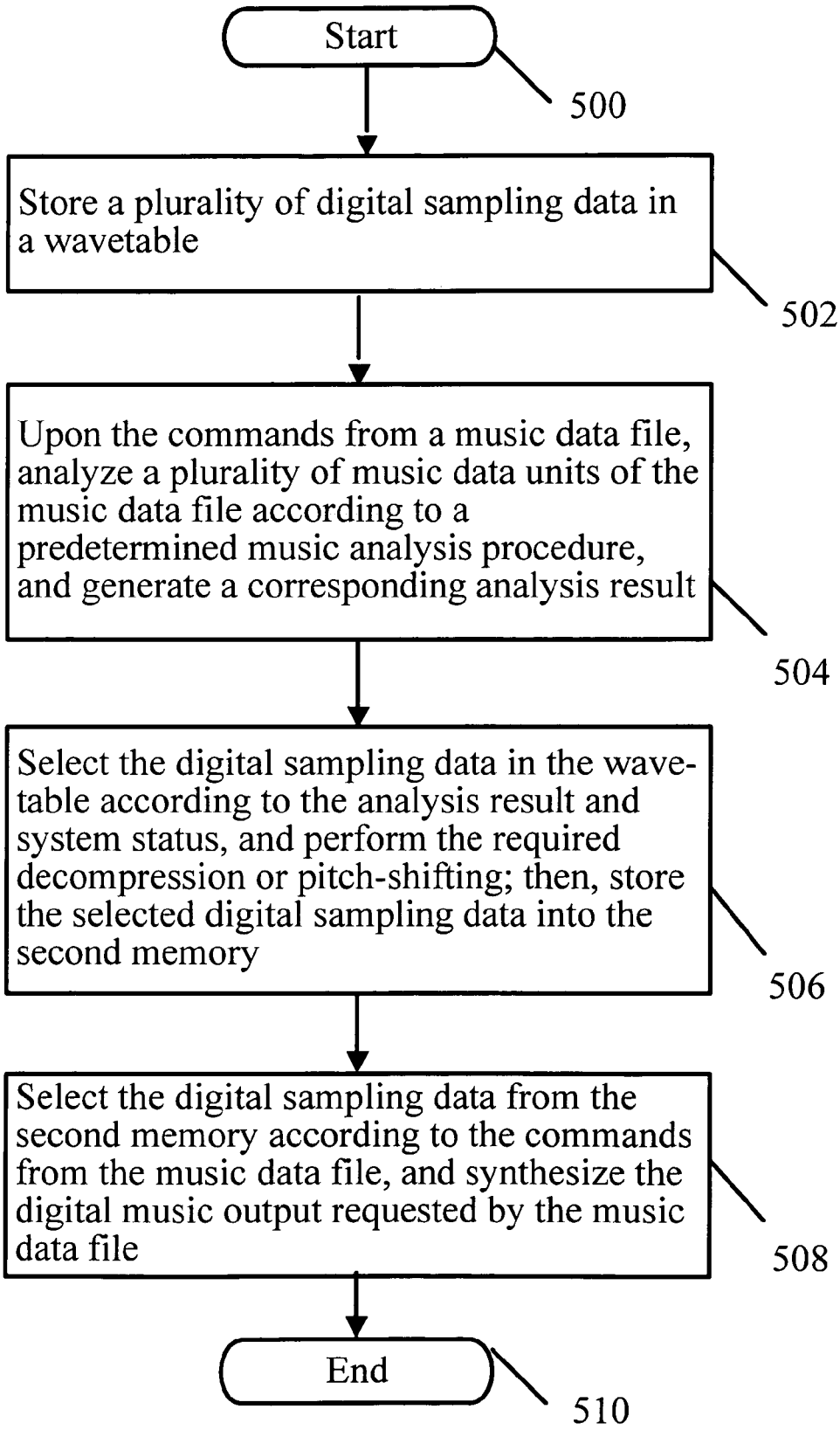
FIG. 5 is a flow chart of the method, which synthesizes the digital music output by the wavetable, according to the embodiment.

Referring to FIG. 4 and FIG. 5, FIG. 5 is a flow chart of the method, which synthesizes the digital music output 43 by the wavetable 44, according to the embodiment. The method, which synthesizes the digital music output 43 by the wavetable 44, includes the following steps:

Step 500: Start.

Step 502: Store a plurality of digital sampling data in a wavetable 44.

Step 504: Upon the commands from a music data file 42, analyze a plurality of music data units of the music data file 42 according to a predetermined music analysis procedure, and generate a corresponding analysis result 58.

Step 506: Select the digital sampling data in the wavetable 44 according to the analysis result 58 and system status, and perform the required decompression or pitch-shifting; then, store the selected digital sampling data into the second memory 47.

Step 508: Select the digital sampling data from the second memory 47 according to the commands from the music data file 42, and synthesize the digital music output 43 requested by the music data file.

Step 510: End.

According the above, the embodiment provides a music synthesis system and method for performing the memory management according to the importance of a data. Before the synthesizer of the music synthesis system starts to synthesize the digital music output, the embodiments according to the present invention establish the importance analysis table by analyzing the commands from the music data file, so as to permit the digital sampling data with greater importance be stored in the limited-capacity memory. If the capacity of the memory allows, the wavetable preprocessor will perform pitch-shifting to some of the digital sampling data and store the data in the memory, so as to share the processing load of the synthesizer and avoid performing the required calculations of pitch-shifting repeatedly. Therefore, the music synthesis system decreases the cost and processing load when the music synthesis system stores the wavetable, and the process does not affect the quality of the digital music output.

The above-mentioned embodiments use two memories, namely the first memory 46 and the second memory, for illustration. The first memory 46 is used for pre-storing the compressed digital sampling data. The second memory 47 is used for temporarily storing the decompressed digital sampling data, so as to allow the data reading by the synthesizer 52 later on. The music synthesis system can certainly use two different memories, or use one single memory with a larger memory capacity and divided into two areas.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A music synthesis system for receiving a music data file, and generating a digital music output, comprising:

a memory;

a wavetable for storing a plurality of digital sampling data, each of the plurality of digital sampling data representing audio signals generated by a musical instrument at a predetermined pitch;

a music analyzer for receiving the music data file, analyzing the music data file, and generating an analysis result;

a wavetable preprocessor for selecting the digital sampling data according to the analysis result and system status, and for processing and storing the selected digital sampling data in the memory before playing back the music data file; and a synthesizer for selecting a set of digital sampling data from the memory according to the music data file, and synthesizing the digital music output;

wherein the synthesizer selects a set of digital sampling data from the memory according to the music data file and performs a pitch-shifting, so as to synthesize the digital music output;

wherein the wavetable preprocessor performs the pitch-shifting to at least some of the digital sampling data and stores the data generated by the pitch-shifting in the memory if the memory capacity is permitted to accept storing the additional data generated by the pitch-shifting, so that the synthesizer does not need to perform pitch-shifting in real time and a operation loading for the synthesizer is reduced.

2. The music synthesis system of claim 1, wherein the music data file comprises a plurality of music data units, and the music data unit records a current pitch, playback duration, and type of the musical instrument of the music.

3. The music synthesis system of claim 2, wherein the music analyzer analyzes the music data file by an analysis procedure, and the analysis procedure performs classification, statistics, and sorting to all the music data units according to the type of the musical instrument or the pitch recorded in the music data units, so as to obtain the analysis results.

4. The music synthesis system of claim 3, wherein the wavetable preprocessor decides which among the digital sampling data in the wavetable are required to be stored in the memory according to the analysis results, and the analysis result of each digital sampling data depends on contribution of the digital sampling data from which the digital music output is synthesized, and the analysis result is arranged and sorted according to the contributions of the digital sampling data.

5. The music synthesis system of claim 4, wherein one or multiple digital sampling data of one particular musical instrument is simulated by pitch-shifting, the digital sampling data of another pitch of the same musical instrument is thus created, and during the analysis of the music data units, if the usage frequency of one digital sampling data or the frequency of the digital sampling data, from which the digital sampling data of other pitches are simulated, is higher, the contribution of the digital sampling data is deemed larger.

6. The music synthesis system of claim 5, wherein, during the synthesis of the digital music output, if the playback duration of one digital sampling data or the duration of one digital sampling data, from which the digital sampling data of other pitches are simulated, is longer, the contribution of the digital sampling data is deemed larger.

7. The music synthesis system of claim 1, wherein the digital sampling data stored in the wavetable comprise a plurality of orchestral music sampling data and a plurality of percussion music sampling data.

8. The music synthesis system of claim 1, wherein the digital sampling data are reduced in size through a predetermined data compression procedure and are stored in the wavetable.

9. The music synthesis system of claim 1, wherein the system status is the memory capacity of the system.

10. A method for synthesizing a digital music output, the method comprising:

storing a plurality of digital sampling data in a wavetable, each of the plurality of digital sampling data representing audio signals generated by a musical instrument at a predetermined pitch;

upon receiving the music data file, analyzing the music data file and generating an analysis result;

selecting the digital sampling data according to the analysis result and system status, and processing and storing the selected digital sampling data in a memory before playing back the music data file; and selecting a set of digital sampling data from the memory according to the music data file, and synthesizing the digital music output;

wherein selecting a set of the digital sampling data from the memory according to the music data file further comprises the step of performing a pitch-shifting, so as to synthesize the digital music output;

wherein processing and storing the selected digital sampling data in the memory farther comprises the steps of performing the pitch-shifting to at least some of the digital sampling data and storing the data generated by the pitch-shifting in the memory if the memory capacity is permitted to accept storing the additional data generated by the pitch-shifting, so that the pitch-shifting does not need to be performed in real time and a complexity of the synthesizing operation is reduced.

11. The method of claim 10, wherein the music data file comprises a plurality of music data units, and the music data unit records a current pitch, playback duration, and type of the musical instrument of the music.

12. The method of claim 11, wherein the method further analyzes the music data file by an analysis procedure, and the analysis procedure performs classification, statistics, and sorting to all the music data units according to the type of the musical instrument or the pitch recorded in the music data units, so as to obtain the analysis results.

13. The method of claim 12, wherein the method further decides which among the digital sampling data in the wavetable are required to be stored in the memory according to the analysis results, and the analysis result of each digital sampling data depends on contribution of the digital sampling data from which the digital music output is synthesized, and the analysis result is arranged and sorted according to the contributions of the digital sampling data.

14. The method of claim 13, wherein one or multiple digital sampling data of one particular musical instrument is simulated by the pitch-shifting, the digital sampling data of another pitch of the same musical instrument is thus created, and during the analysis of the music data units, if the usage frequency of one digital sampling data or the frequency of the digital sampling data, from which the digital sampling data of other pitches are simulated, is higher, the contribution of the digital sampling data is deemed larger.

15. The method of claim 14, wherein during the synthesis of the digital music output, if the playback duration of one digital sampling data or the duration of one digital sampling data, from which the digital sampling data of other pitches are simulated, is longer, the contribution of the digital sampling data is deemed larger.

16. The method of claim 10 further comprising:

selecting the digital sampling data with relatively greater importance in the wavetable;

performing pitch-shifting to part of the digital sampling data; and storing the data in the memory, so as to share the processing load and speed up the synthesis of the digital music output.

* * * * *